US009784048B2

(12) United States Patent
Moyer et al.

(10) Patent No.: US 9,784,048 B2
(45) Date of Patent: Oct. 10, 2017

(54) DRILL STRING STABILIZER RECOVERY IMPROVEMENT FEATURES

(71) Applicants: Mark C. Moyer, The Woodlands, TX (US); Paul E. Pastusek, The Woodlands, TX (US); Eileen Louvier, Houston, TX (US)

(72) Inventors: Mark C. Moyer, The Woodlands, TX (US); Paul E. Pastusek, The Woodlands, TX (US); Eileen Louvier, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 30 days.

(21) Appl. No.: 14/431,658

(22) PCT Filed: Sep. 27, 2013

(86) PCT No.: PCT/US2013/062300
§ 371 (c)(1),
(2) Date: Mar. 26, 2015

(87) PCT Pub. No.: WO2014/081503
PCT Pub. Date: May 30, 2014

(65) Prior Publication Data

US 2015/0252630 A1 Sep. 10, 2015

Related U.S. Application Data

(60) Provisional application No. 61/728,708, filed on Nov. 20, 2012.

(51) Int. Cl.
*E21B 17/10* (2006.01)
*E21B 7/06* (2006.01)
(Continued)

(52) U.S. Cl.
CPC ..... *E21B 17/1078* (2013.01); *E21B 7/04* (2013.01); *E21B 7/06* (2013.01); *E21B 17/006* (2013.01);
(Continued)

(58) Field of Classification Search
CPC ... E21B 7/04; E21B 7/06; E21B 7/062; E21B 7/065; E21B 17/10; E21B 17/1078; E21B 17/12
See application file for complete search history.

(56) References Cited

U.S. PATENT DOCUMENTS 3,556,233 A * 1/1971 Gilreath ..... E21B 10/322 175/267
4,388,974 A 6/1983 Jones, Jr. et al.
(Continued)

FOREIGN PATENT DOCUMENTS

WO WO 2010/127450 A1 11/2010

*Primary Examiner* — David Bagnell
*Assistant Examiner* — Tara Schimpf
(74) *Attorney, Agent, or Firm* — ExxonMobil Upstream Research Company Law Department

(57) ABSTRACT

A stabilizer design for improving the likelihood of recovery of a drill string when obstructions are encountered in a wellbore is disclosed herein. The stabilizer includes a tubular body, a track, and a stabilizer blade. The track is disposed along the tubular body. The stabilizer blade is operatively coupled to the track and is configured to slide along the track from a first position to a second position.

21 Claims, 20 Drawing Sheets

1000

1100

(51) Int. Cl.
*E21B 7/04* (2006.01)
*E21B 17/00* (2006.01)
*E21B 41/00* (2006.01)

(52) U.S. Cl.
CPC ..... *E21B 41/0078* (2013.01); *E21B 17/1014* (2013.01)

(56) References Cited

U.S. PATENT DOCUMENTS

| | | | | |
|---|---|---|---|---|
| 4,491,187 | A | 1/1985 | Russell | |
| 4,754,821 | A | 7/1988 | Swietlik | |
| 5,293,945 | A | 3/1994 | Rosenhauch et al. | |
| 5,311,953 | A | 5/1994 | Walker | |
| 5,318,138 | A | 6/1994 | Dewey et al. | |
| 5,655,609 | A | 8/1997 | Brown et al. | |
| 5,931,239 | A | 8/1999 | Schuh | |
| 6,213,226 | B1 | 4/2001 | Eppink et al. | |
| 7,299,885 | B2 * | 11/2007 | Baird | E21B 17/05 166/301 |
| 7,434,631 | B2 | 10/2008 | Krueger et al. | |
| 7,681,665 | B2 | 3/2010 | Eppink | |
| 7,878,272 | B2 | 2/2011 | Eppink | |
| 2007/0089912 | A1 * | 4/2007 | Eddison | E21B 10/32 175/269 |
| 2008/0128169 | A1 | 6/2008 | Radford et al. | |

* cited by examiner

100

200

300

300

300

400

400

500

600

700

700

700

800

800

900

900

900

1000

1000

1100

1100

1200

1300

1400

1400

1400

1500

DRILL STRING STABILIZER RECOVERY IMPROVEMENT FEATURES

CROSS REFERENCE TO RELATED APPLICATIONS

This application is the National Stage of International Application No. PCT/US2013/062300, filed Sep. 27, 2013, which claims the benefit of U.S. Provisional Application No. 61/728,708, filed Nov. 20, 2012, the disclosure of which is hereby incorporated by reference.

FIELD OF THE INVENTION

The present invention relates to devices for down hole drilling operations. More particularly, systems and methods for reducing the likelihood of permanently sticking the drill string are described.

BACKGROUND OF THE INVENTION

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

A stabilizer is an implementation used in downhole drilling operations to hold a drill string essentially concentrically in place. A stabilizer can be composed of a cylindrical body and a set of stabilizer blades that form an effective diameter similar to that of the drill string's drill bit which is nominally the same diameter as the wellbore (or borehole) when initially drilled. The stabilizer blades can help keep the drill string aligned so as to avoid unintentional sidetracking or vibrations and to reduce the contact area between the drill string and the wellbore during the drilling operation.

However, when pulling the drill string out of a wellbore after the drilling operation, the blades of a stabilizer can be at risk of being caught on an obstruction such as a debris build-up or a cuttings bed or formation ledge, which would subject the stabilizer to a downward axial force. These occurrences can cause damage to or loss of the drilling tools. Additionally, it may take several days and millions of dollars in order to safely remove a stuck drill string or in many instances, part of the drill string is permanently lost (unrecoverable) and a new wellbore must be drilled.

Several patents and pieces of literature discuss systems in which stabilizer blades can be extended or retracted. U.S. Pat. No. 5,931,239 discusses a drill string carrying a stabilizer sub above a drill bit for steering or directing drilling. The stabilizer body is rotatably carried by the stabilizer sub such that the stabilizer body remains substantially stationary relative to the borehole as the drill string rotates. At least one stabilizer blade is carried by the stabilizer body, with the stabilizer blade being radially extendable from the stabilizer body and into engagement with the sidewall of a borehole. Each stabilizer blade is extendable and retractable from the stabilizer body independently of the others. The stabilizer blades are coupled to the stabilizer body such that the stabilizer blades are capable of collapsing to a minimum radial extension if the stabilizer assembly becomes stuck in the borehole.

U.S. Pat. No. 4,491,187 discusses a surface controlled blade stabilizer apparatus, in which surface control is achieved by the alteration of internal drill string pressure to move a piston carrying an actuator for expanding stabilizer blades. The stabilizer blades are spring biased inwardly when not forced outwardly by the actuator. A barrel cam controls and guides the actuator to downward, upward, and intermediate positions, such that the blades may be expanded, retracted, or held expanded when drill string pressure is reduced. The apparatus has a full open passage to allow passage of the drilling fluid (or mud) which is not interfered with by operation of the apparatus.

U.S. Pat. No. 4,754,821 discusses a locking device for use in an adjustable drill string stabilizer that comprises a fluid reservoir provided in a first body member. The reservoir is divided into two chambers by a sealing piston secured on a second body member that is moveable relative to the first body member. The chambers of the reservoir are in fluid communication through a valve which is actuatable to close said fluid communication between the chambers, thus preventing relative movement of the body members.

U.S. Pat. No. 5,293,945 discusses a downhole adjustable stabilizer and method for use in a wellbore and along a drill string having a bit at its lower end. A plurality of stabilizer blades are radially moveable with respect to the stabilizer body, with outward movement of each stabilizer blade being in response to a radially moveable piston positioned inwardly of a corresponding blade and subject to the pressure differential between the interior or the stabilizer and the wellbore. A locking member is axially moveable from an unlocked position to a locked position, such that the stabilizer blades may be locked in either their retracted or expanded positions. In the preferred embodiment of the invention, the stabilizer may be sequenced from a stabilizer blade expanded position to a stabilizer blade retracted position by turning on and off a mud pump at the surface. The stabilizer position may be detected by monitoring the back pressure of the mud at the surface, since the axial position of the locking sleeve preferably alters the flow restriction at the lower end of the stabilizer. High radially outward forces may be exerted on each stabilizer blade by one or more radially moveable pistons responsive to the differential pressure across the stabilizer, and the stabilizer is presumed to be highly reliable and has few force-transmitting components.

U.S. Pat. No. 5,311,953 discusses a trajectory control sub for steering a drill bit that contains a lower part adjustable relative to an upper part to produce an axial bend to angularly offset the drill bit so that drilling proceeds along a curved path. Adjustable stabilizer blades are mounted on the sub and are moveable between extended positions and retracted positions. An actuator is provided which selectively maintains the drill bit in axial alignment with the section of borehole being drilled, and which is actuated to move the stabilizer blades into their retracted positions and subsequently, with the stabilizer blades in their retracted positions, to effect tilting of the lower part relative to the upper part to produce the axial bend leading to tilting of the drill bit.

These references disclose extending and retracting stabilizer blades with the use of hydraulics, an actuator, or pistons. However, at present, there is not a known uniaxial, mechanical-only stabilizer with retractable stabilizer blades in the oilfield or wellbore drilling industry.

SUMMARY OF THE INVENTION

An exemplary embodiment provides a stabilizer. The stabilizer includes a tubular body, a track, and a stabilizer blade. The track is disposed along the tubular body. The stabilizer blade is operatively coupled to the track, wherein the track allows the stabilizer blade to slide from a first position to a second position.

Another exemplary embodiment provides a method for stabilizing a drill string in a wellbore. The method includes advancing the drill string into the wellbore. The method also includes centering the drill string with a plurality of stabilizer blades disposed along the drill string, wherein each of the plurality of stabilizer blades remains at a first position on a track as the drill string is advanced into the wellbore. The method also includes retracting the drill string in the wellbore, wherein a stabilizer blade will slide to a second position along the track in response to being caught on an obstruction in the wellbore.

Another exemplary embodiment provides a stabilizer. The stabilizer includes a stabilizer blade operatively coupled to a track, wherein if the stabilizer blade encounters an obstruction in the wellbore as the drill string is being retracted in the well, the stabilizer blade slides on the track.

Another exemplary embodiment provides a method of minimizing sticking between a stabilizer blade and an obstruction in a wellbore. The method includes rotating a stabilizer blade with a drill string while the stabilizer blade remains in a first position on the drill string. The method also includes establishing contact with an obstruction as the drill string is pulled. The method also includes sliding along a track until a second position is reached. The method further includes moving to the first position as the drill string moves down for drilling.

Another exemplary embodiment provides a system for improving the probability of recovery of a drill string in a well. The system includes a drill string. The system also includes a stabilizer that includes a stabilizer blade. The stabilizer blade is operatively coupled to a track. If the stabilizer blade encounters an obstruction in the well, the stabilizer blade slides on the track. Another feature that is provided is a fluid circulation port(s) or nozzle(s) that is opened when the stabilizer blade is shifted due to the obstruction. Drilling fluid can be pumped through the port(s) to help clear the debris causing the obstruction. The port(s) or nozzle(s) may provide a relatively high pressure drop to provide a jetting action or relatively lower pressure drop to facilitate high rate circulation and turbulence, or even a relatively further reduced pressure drop merely to establish hole cleaning circulation rates to facilitate drilling fluid and cuttings circulation and removal. The circulation port(s) or nozzle(s) may be referred to herein collectively and broadly as hydraulic jet nozzle(s), regardless of the amount of pressure drop or jetting energy provided by such port(s) or nozzle(s), as many embodiments will provide at least some energized jetting action. Such nozzles may be selectively operable, such as via use of a rupture disk or valve assembly or operable any time the port is opened such as by shifting of a stabilizer blade or other component, or selectively operable independent of the position of the blade or other component.

The foregoing summary has outlined rather broadly the features and technical advantages of embodiments in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DESCRIPTION OF THE DRAWINGS

The foregoing and other advantages of the present invention may become apparent upon reviewing the following detailed description and drawings of non-limiting examples of embodiments in which.

Figure 1:
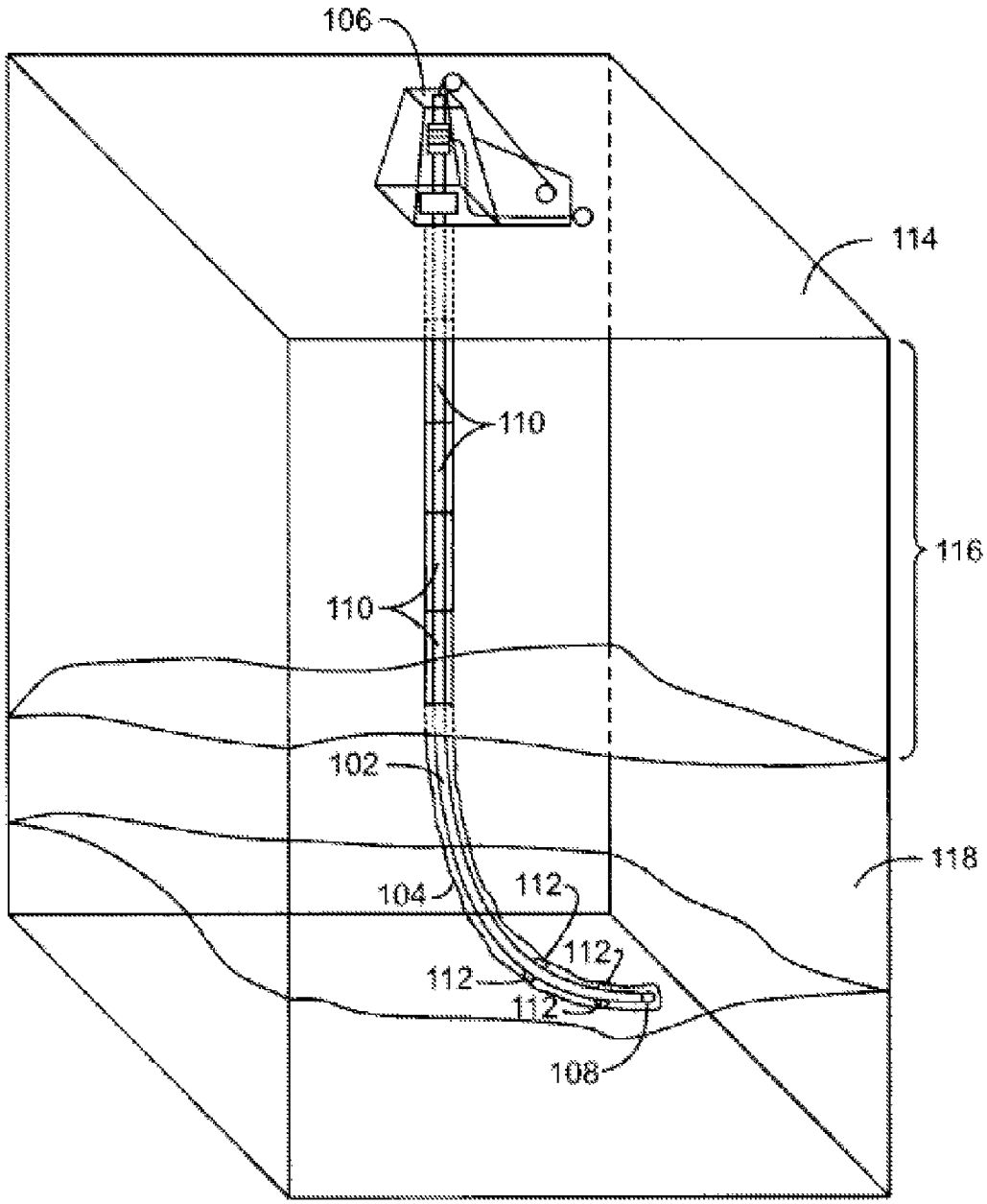
FIG. 1 is an illustration of a system for downhole drilling.

It should be noted that the figures are merely exemplary of several embodiments of the present invention and no limitations on the scope of the present invention are intended thereby. Further, the figures are generally not drawn to scale, but are drafted for purposes of convenience and clarity in illustrating various aspects of the invention.

DETAILED DESCRIPTION OF THE INVENTION

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

"Blade" and "blades" may be used in this application to include, but are not limited to, various types of projections extending outwardly from a wellbore tool. Such wellbore tools may have generally cylindrical bodies with associated blades extending radially therefrom. Blades formed in accordance with teachings of the present disclosure may have a wide variety of configurations including, but not limited to, helical, spiraling, tapered, converging, diverging, symmetrical, and/or asymmetrical. Such blades may also be used on wellbore tools which do not have a generally cylindrical body.

"Drilling" as used herein may include, but is not limited to, rotational drilling, slide drilling, directional drilling, non-directional (straight or linear) drilling, deviated drilling, geosteering, horizontal drilling, and the like. The drilling method may be the same or different for the offset and uncased intervals of the wells. Rotational drilling may involve rotation of the entire drill string, or local rotation downhole using a drilling mud motor, where by pumping mud through the mud motor, the bit turns while the drillstring does not rotate or turns at a reduced rate, allowing the bit to drill in the direction it points.

A "drill string" is understood to include a collection or assembly of joined tubular members, such as casing, tubing, jointed drill pipe, metal coiled tubing, composite coiled tubing, drill collars, subs and other drill or tool members, extending between the surface and on the lower end of the work string, is connected to a tool normally utilized in wellbore operations called a drill bit. The drill bit is used to cut or crush the formation rocks to form a wellbore (or borehole). A drill string may be used for drilling and be a drill string or an installation means. It should be appreciated that the work or drill string may be made of steel, a steel alloy, a composite, fiberglass, or other suitable material.

A "sleeve" is a tubular part designed to fit over another tubular part. The inner and outer surfaces of the sleeve may be circular or non-circular in cross-section profile. The inner and outer surfaces may generally have different geometries, i.e. the outer surface may be cylindrical with circular cross-section, whereas the inner surface may have an elliptical or other non-circular cross-section. Alternatively, the outer surface may be elliptical and the inner surface circular, or some other combination. More generally, a sleeve may be considered to be a generalized hollow cylinder with one or more radii or varying cross-sectional profiles along the axial length of the cylinder.

A "tubular" is used herein to include oil country tubular goods and accessory equipment such as drill string, liner hangers, casing nipples, landing nipples and cross connects associated with completion of oil and gas wells. Tubulars also include any pipe of any size or any description and is not limited to only tubular members associated with oil and gas wells. Further, the term "tubular" is not restricted to flow spaces with a cylindrical shape (i.e., with a generally circular axial cross-section), but is instead intended to encompass enclosed flow spaces of any other desired cross-sectional shape, such as rectangular, hexagonal, oval, annular, non-symmetrical, etc. In addition, the term tubular also contemplates enclosed flow spaces whose cross-sectional shape or size varies along the length of the tube.

A "well" refers to holes drilled vertically, at least in part, and may also refer to holes drilled with deviated, highly deviated, and/or horizontal sections of the wellbore. The term also includes wellhead equipment, surface casing, intermediate casing, and the like, typically associated with oil and gas wells.

According to embodiments described herein, a stabilizer on a drill string is configured to reduce the contact area between the drill string and the wellbore and to minimize drill string sticking or drag. The improved stabilizer may be incorporated into method and systems for improving the probability of recovery of a drill string in a wellbore or mitigate potential sticking of a drillstring within a wellbore.

Multiple stabilizers can be used to help achieve a specified directional path for the wellbore as well as reduce the overall drag on the drill string. The stabilizer may include one or more stabilizer blades that form an effective diameter that is substantially the same as the drill bit to keep the drill string in place to avoid unintentional sidetracking or vibrations during operation. After operation, the drill string is pulled out of the wellbore. If a stabilizer blade encounters an obstruction in the well, the stabilizer blade can slide along a track on the stabilizer. In some embodiments, the stabilizer blade slides into recessed areas on the stabilizer body, so as to allow the stabilizer to slip past the obstruction. In other embodiments, the drill string is shifted downward and pulled upward while the stabilizer blade is stuck in order to attempt to dislodge the obstruction.

In some embodiments, the stabilizer blade is secured in place by a shearable device such as a shear pin, screw, or detent that can release the stabilizer blade only when a pre-determined axial force threshold is met. The stabilizer may contain mechanical stops to prevent the stabilizer blade from sliding upward or downward past a certain point. If the drill string is to go back down for further drilling operations, the stabilizer blade can return to its original position. The stabilizer blade may be aligned with the axis of the drill string, or it may be aligned at an angle from the axis of the drill string so as to make a spiral pattern.

Another feature that may be included is a fluid circulation port(s) or nozzle(s) (collectively also referred to herein as a hydraulic jet nozzle) that is opened when the stabilizer blade is shifted due to the obstruction. Drilling fluid can be pumped through the port(s) to help clear the debris causing the obstruction. The port(s) or nozzle(s) may provide a relatively high pressure drop to provide a jetting action or relatively lower pressure drop to facilitate high rate circulation and turbulence, or even a relatively further reduced pressure drop merely to establish hole cleaning circulation rates to facilitate drilling fluid and cuttings circulation and removal. The circulation port(s) or nozzle(s) may be referred to herein collectively and broadly as hydraulic jet nozzle(s), regardless of the amount of pressure drop or jetting energy provided by such port(s) or nozzle(s), as many embodiments will provide at least some energized jetting action. Such nozzles may be selectively operable, such as via use of a rupture disk or valve assembly or operable any time the port is opened such as by shifting of a stabilizer blade or other component, or selectively operable independent of the position of the blade or other component.

In some embodiments, a hydraulic jet nozzle may be included on the track to release a drilling fluid, for example, after the stabilizer blade has moved aside, leaving the nozzle open. As used herein, "open" means that the nozzle allows unimpeded flow of a fluid into the wellbore. The nozzle may be an aperture, a port, a hydraulic jet, a slot, an insert, or an orifice, or combinations thereof. The nozzle may also include a gasket, valve, check valve, other flow control device, or combinations thereof. The released drilling fluid can act as a lubricant or help displace, hydrate, dislodge, unpack, or re-suspend portions of the obstructive debris within the wellbore annulus. Such actions may aid recovery of a drill string or prevent sticking the drill string. In some embodiments, a sealing mechanism such as a gasket, valve, check valve, or other flow control device may be in place to block the nozzle, e.g., to prevent the drilling fluid from flowing or leaking out when the stabilizer blade is positioned over the hydraulic jet nozzle.

FIG. 1 is an illustration of a system for downhole drilling. The system 100 includes a drill string 102 operating in a wellbore 104. The drill string 102 can be operatively coupled to a motor 106 configured to rotate, push, and pull the drill string 102. The drill string 102 can include a drill bit 108 and a multiple drill string segments 110 that can be removed and replaced. Stabilizers 112, placed along the drill string 102, can keep the drill bit 108 in line with the wellbore 104, preventing undesirable deviations and also reducing the contact area between the drill string and the wellbore. The motor 106 can operate the drill string 102 from the top of a surface 114. The wellbore 104 can be a hole cutting through overburden 116 into a reservoir 118. The stabilizer blades are designed to rotate in fixed engagement with the rotation of the drill string to mechanically agitate the drilled cuttings and aid in the removal of these cuttings from the wellbore. Furthermore, field testing has shown that generally a rotating stabilizer induces less axial and rotational drag than a static (non-rotating) stabilizer which is a significant benefit in long-reach directional wells.

Figure 2:
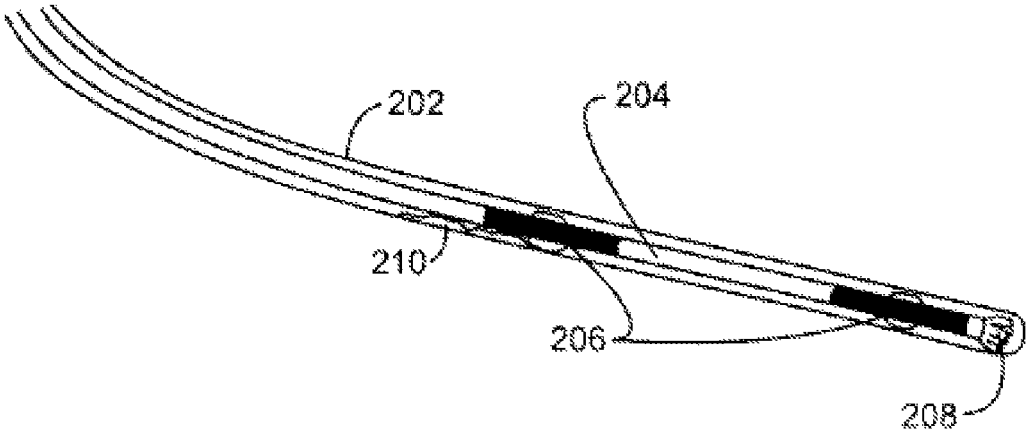
FIG. 2 is an illustration of a drill string in a wellbore showing the binding or undesirable contact of stabilizers on an obstruction.

FIG. 2 is an illustration of a drill string in a wellbore showing the binding or undesirable contact of stabilizers on an obstruction. The drill string 200 can operate in a wellbore 202, and may be composed of alternating segments of drill pipe, drill collars 204, stabilizers 206, and a drill bit 208. The stabilizers 206 can help keep the drill string in place during drilling operation. When the drill string is pulled up towards the surface, the stabilizers 206 run the risk of being stuck on an obstruction 210 in the wellbore 202.

The drill bit 208 is configured to drill the wellbore 202. The drill collars 204 may be heavy, thick-walled sections of the drill string 200 that provide weight to the drill bit 208. Obstructions 210 in the wellbore that can impede the stabilizer blades 206 may include loose or unstable formations or rock cuttings that remain after drilling. After drilling the wellbore using the drill string and stabilizer, hydrocarbons such as oil or gas may be produced from the wellbore or recovered from other wellbore in the field as a direct or indirect result of operations utilizing the wellbore.

In some embodiments, the stabilizer blades 206 are configured to slide if they are impeded. The stabilizer blades 206 can be composed of one or two pieces. In some embodiments, the stabilizer blades 206 are coupled to a sleeve that retains its effective diameter.

Figure 3A:
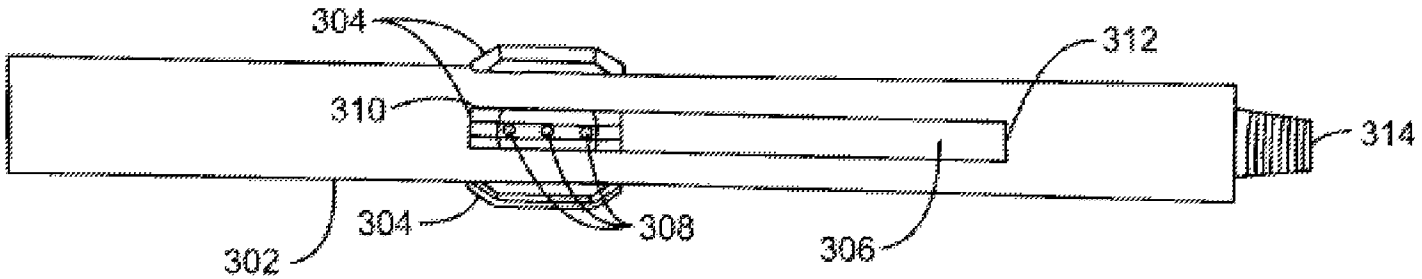
FIGS. 3A and 3B are side views of a four-blade stabilizer with blades extended and retracted, respectively, with FIG. 3C showing an embodiment with a fluid jet nozzle.
Figure 3B:
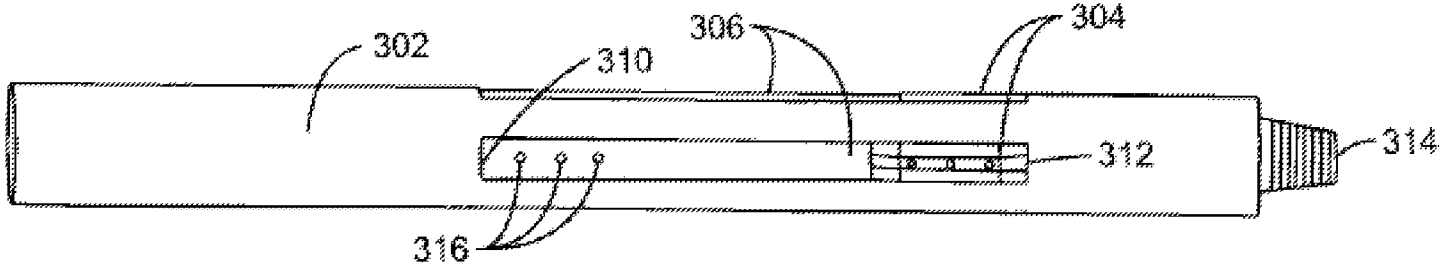

FIGS. 3A and 3B are side views of a four-blade stabilizer with blades extended and retracted. The four-blade stabilizer 300 can have a stabilizer body 302 with four one-piece stabilizer blades 304, each contained in a stabilizer blade slot 306, which may be angled inward. The one-piece stabilizer blades 304 may be held in place by shearable devices 308 such as shear pins, screws, or ball detents. The stabilizer blade slots 306 may each contain an upper mechanical stop 310 and a lower mechanical stop 312 that serve to prevent the one-piece stabilizer blades 304 from sliding past a certain point. The four-blade stabilizer 300 can be inserted into a drill string by a drill string connection 314, which can be a conventional pin or box thread. The drill string connection 314 may point towards the drill bit of the drill string.

FIG. 3A represents the four-blade stabilizer 300 during drilling operation in a well, when the one-piece stabilizer blades 304 are in an extended position, and held in place by the shearable devices 308 and the upper mechanical stop 310. When the drill string is pulled upwards, one or more of the one-piece stabilizer blades 304 may encounter an obstruction in the well.

If enough force is applied onto the stabilizer blade 304, the shearable devices 308 can release the one-piece stabilizer blade 304, allowing it to slide down the stabilizer blade slot 306 until reaching the lower mechanical stop 312, revealing shearing pin holes 316. In many embodiments the stabilizer blade is a one-piece element, but in other embodiments the blade may comprise two or more integrated or cooperating elements. The shearable devices 308 may include shear pins that break when a force exceeds a set point. For example, the total shear force may be set to allow the stabilizer blade 304 to move when a force is applied to the stabilizer blade 304 of about 20,000 lbs (about 9100 kg), about 30,000 lbs (about 14000 kg), about 40,000 lbs (about 18,000 kg), or about 50,000 lbs (about 23,000 kg), or otherwise as appropriate for the use conditions. It can be noted that this force is measured at the stabilizer blade 304, and is above any force needed to pull the drill string from the wellbore. Further, this force can be divided among a number of shearable devices 308. For example, if three shear pins are used, each shear pin can be set to break at about 10,000 lbs (about 4500 kg), for a total force of about 30,000 lbs (about 14000 kg). The shearable devices 308 are not limited to shear pins, but can also include detents (such as spring-loaded spheres or hemispheres) that lock the stabilizer blades 304 into place at the forces described.

Figure 3C:
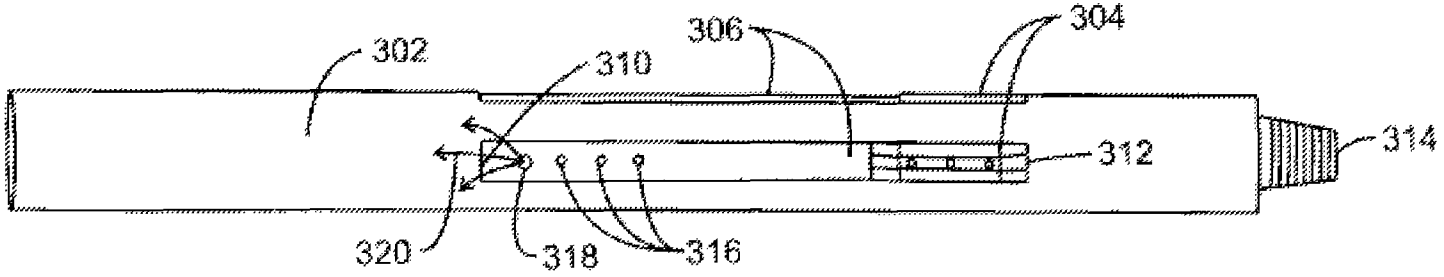

The shearing holes 316 correspond to where the shearable devices 308 were originally held in place. If the stabilizer blade slot 306 is angled into the drill pipe, the one-piece stabilizer blade 304 can retract into the four-blade stabilizer 300 as shown in FIG. 3B. In some embodiments, retracting the one-piece stabilizer blade 304 can expose the fluid jet nozzle 318 (as seen in FIG. 3C), which can release a drilling fluid 320 into the wellbore annulus.

If drilling is to be resumed, the drill string may be pushed downward, and the one-piece stabilizer blade 304 can slide back to its original position at the upper mechanical stop 310. If detents are used, the stabilizer blade 304 may return to a locked condition if the drill string is again advanced into the wellbore.

Figure 4A:
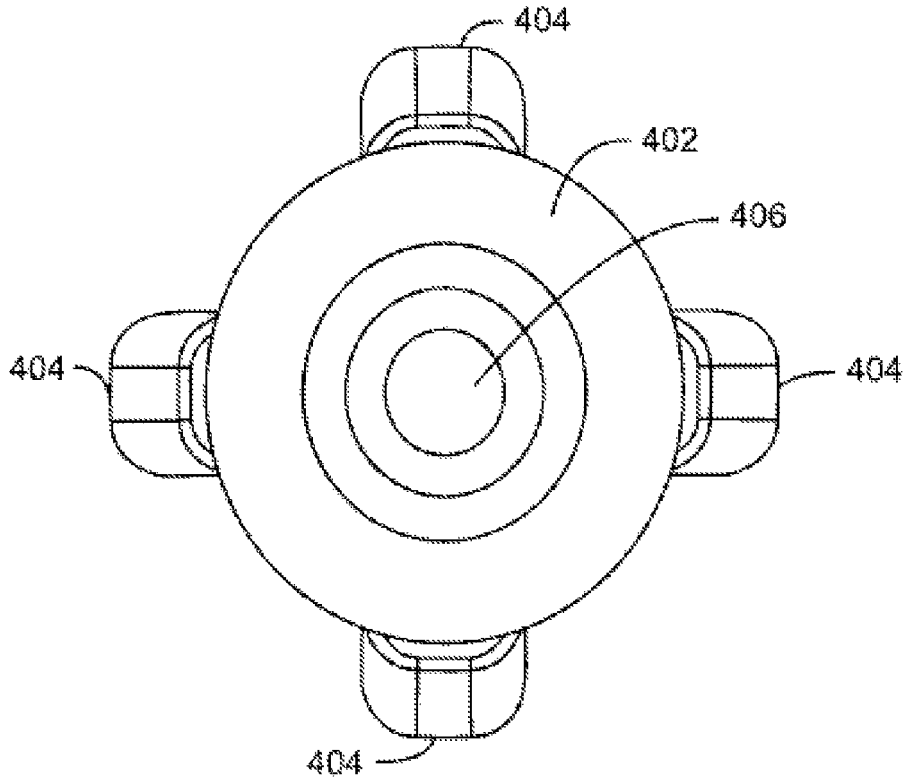
FIGS. 4A and 4B are front views of a four-blade stabilizer with blades extended and retracted, respectively.
Figure 4B:
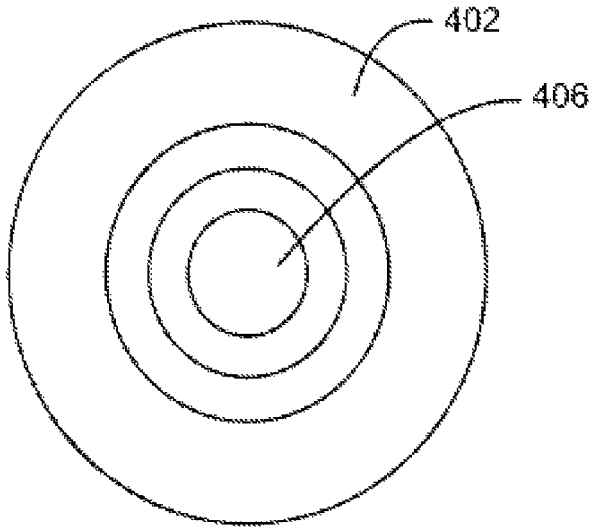

FIGS. 4A and 4B are front views of a four-blade stabilizer with blades extended and retracted. The four-blade stabilizer 400 can have a stabilizer body 402, four one-piece stabilizer blades 404, and a center annulus 406 through which drilling fluid or mud can pass through. During drilling operation in a well, the one-piece stabilizer blades 404 are extended outward to form a larger effective diameter, e.g., to match the diameter of the drill bit, as shown in FIG. 4A. The larger effective diameter helps keep a drill string stable when drilling. As the drill string is pulled upward, if a one-piece stabilizer blades 404 is caught by an obstruction in the well, the one-piece stabilizer blades 404 break free and slide along the track, retracting into a recessed area and reducing the effect diameter so that the stabilizer can bypass the obstruction, as shown in FIG. 4B.

Figure 5:
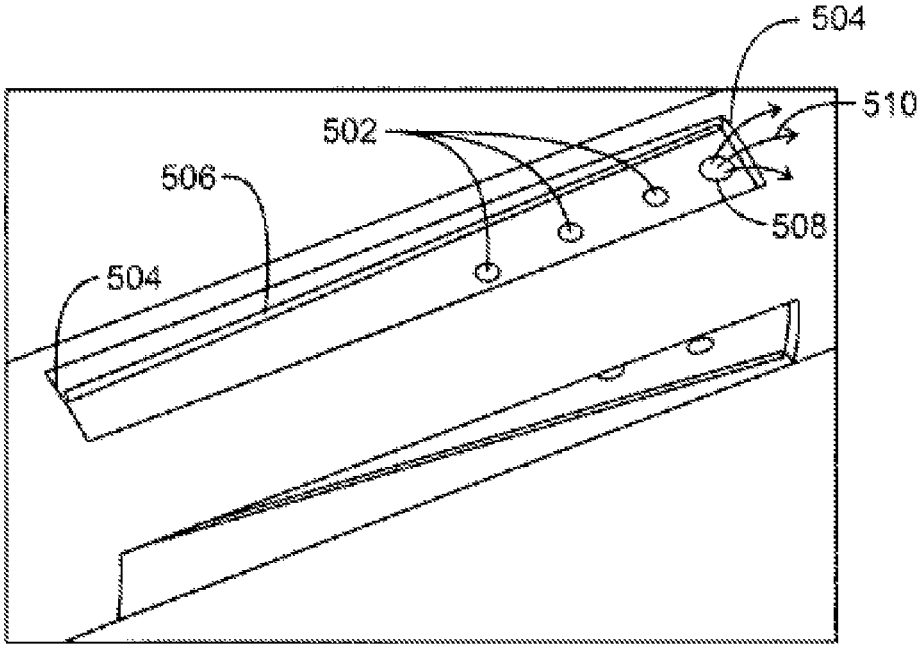
FIG. 5 is a perspective view of a stabilizer track configured to hold a stabilizer blade.

FIG. 5 is a perspective view of a stabilizer track configured to hold a stabilizer blade. The stabilizer track 500 can include one or more shearing holes 502, a pair of mechanical stops 504, and one or more blade retention slots 506. The shearing holes 502 are holders for shearable devices (such as pins or ball detents) that can hold a stabilizer blade in place during drilling operation. If enough force is applied to the stabilizer blade, the shearable devices can release the stabilizer blade (or blades), allowing it to slide within the stabilizer track 500. The mechanical stops 504 constrain the axial movement of the stabilizer blade. The blade retention slot 506 can be configured to prevent stabilizer blade circumferential movement relative to the stabilizer body. The blade retention slot 506 can also ensure that the stabilizer blade does not become detached from the stabilizer body. In some embodiments, the stabilizer track 500 is angled into the stabilizer body such that when the stabilizer blade slides away from its starting position, the stabilizer blade retracts inward so as to reduce the effective diameter formed. In some embodiments, the stabilizer track 500 also contains a hydraulic jet nozzle 508 that can release a drilling fluid 510 into the wellbore annulus.

Figure 6:
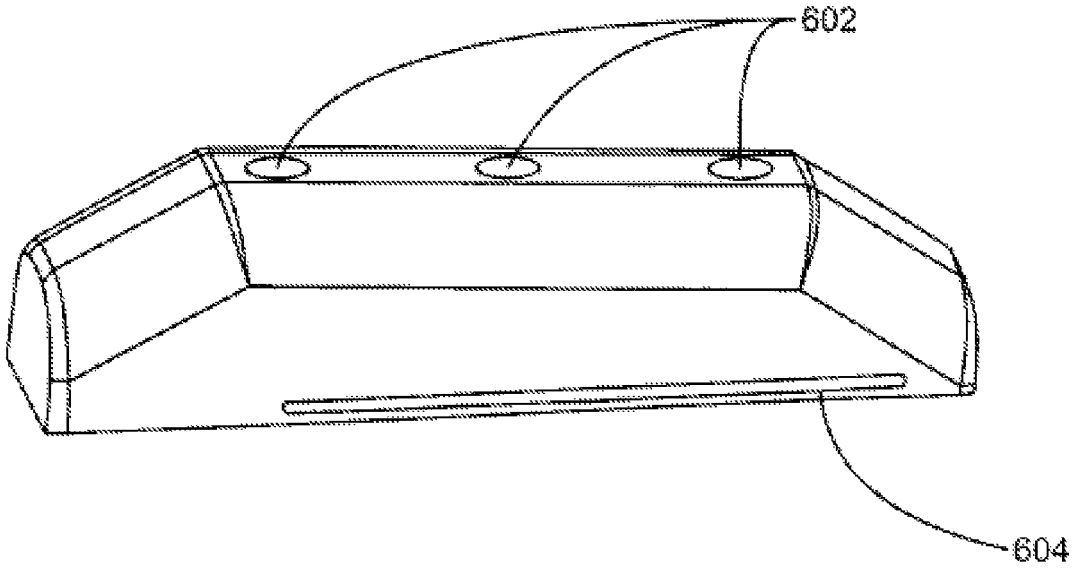
FIG. 6 is a perspective view of a blade.

FIG. 6 is a perspective view of a stabilizer blade. The stabilizer blade 600 is configured to extend outward from a stabilizer on a drill string so as to increase the stabilizer's effective diameter during drilling operation, and slide on a track on the stabilizer when an obstruction is encountered. The stabilizer blade 600 can contain one or more shearing holes 602 and one or more retention blades 604. The shearing holes 602 are holders for shearable devices (such as pins or detents) that can hold the blade 600 in place during drilling operations. The retention blade 604 is a ridge that engages in a blade retention slot on the track to prevent the blade 600 from separating from the stabilizer.

Figure 7A:
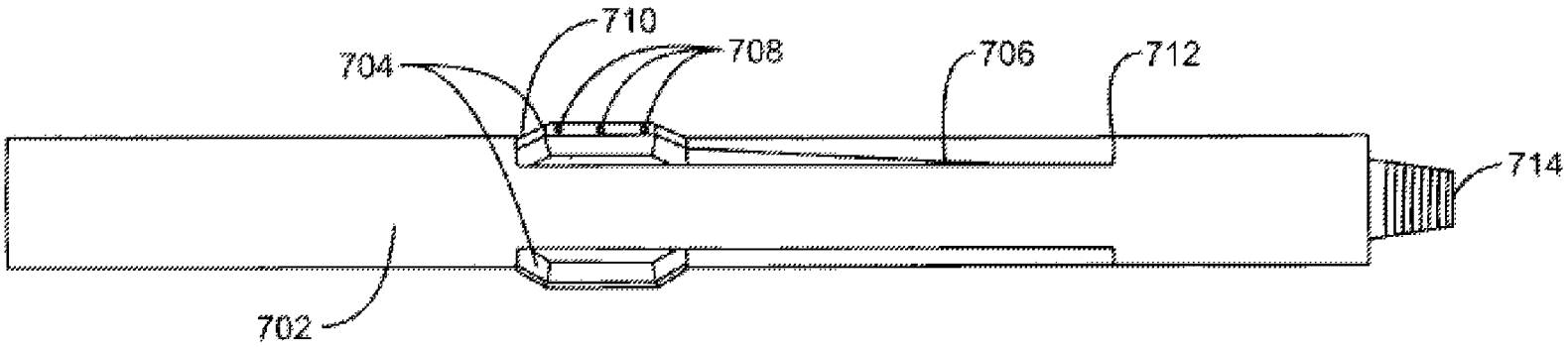
FIGS. 7A and 7B are side views of a three-blade stabilizer with blades extended and retracted, respectively, with FIG. 7C showing an embodiment with a fluid jet nozzle.
Figure 7B:
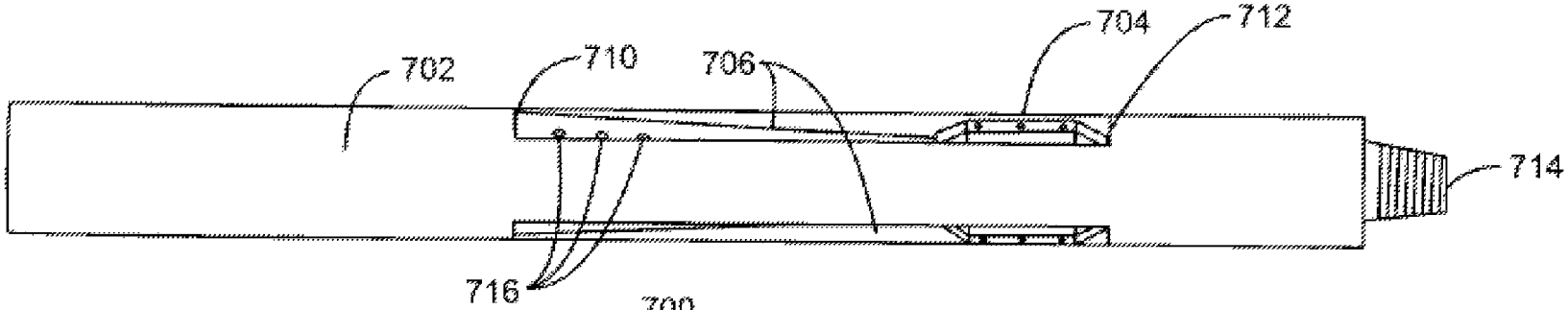

FIGS. 7A and 7B are side views of a three-blade stabilizer with blades extended and retracted. The three-blade stabilizer 700 can have a stabilizer body 702 with three one-piece stabilizer blades 704, each contained in a stabilizer blade slot 706, which may be angled inward. The one-piece stabilizer blades 704 may be held in place by shearable devices 708 such as shear pins or ball detents. The stabilizer blade slots 706 may each contain an upper mechanical stop 710 and a lower mechanical stop 712 that serve to prevent the one-piece stabilizer blades 704 from sliding past a certain point. The three-blade stabilizer 700 can be inserted into a drill string by a drill string connection 714, which can be a conventional pin or box thread. The drill string connection 714 may point towards the drill bit of the drill string.

Figure 7C:
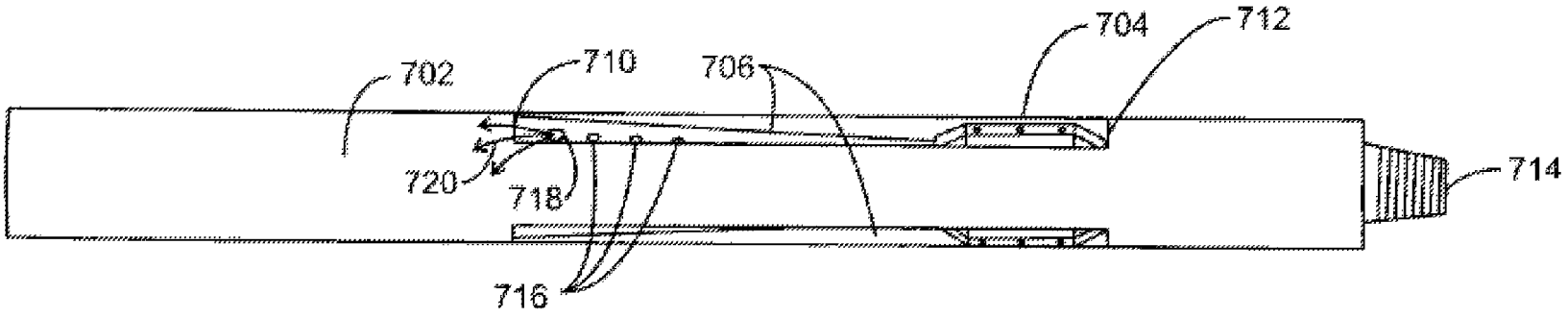

FIG. 7A represents the three-blade stabilizer 700 during drilling operation in a well, when the one-piece stabilizer blades 704 are extended outward, and held in place by the shearable devices 708 and the upper mechanical stop 710. When the drill string is pulled upwards, one or more of the one-piece stabilizer blades 704 may encounter an obstruction in the well. If enough force is applied onto the one-piece stabilizer blade 704, the shearable devices 708 can release the one-piece stabilizer blade 704, allowing it to slide down the stabilizer blade slot 706 until reaching the lower mechanical stop 712, revealing shearing holes 716. The shearing holes 716 correspond to where the shearable devices 708 were originally held in place. If the stabilizer blade slot 706 is angled inward, the one-piece stabilizer blade 704 can retract into the three-blade stabilizer 700 as shown in FIG. 7B. In some embodiments, retracting the one-piece stabilizer blade 704 can expose the fluid jet nozzle 718 (as seen in FIG. 7C), which can release a drilling fluid 720 into the wellbore annulus. If drilling is to be resumed, the drill string may be pushed downward, and the one-piece stabilizer blade 704 can slide back to its original position at the upper mechanical stop 710.

Figure 8A:
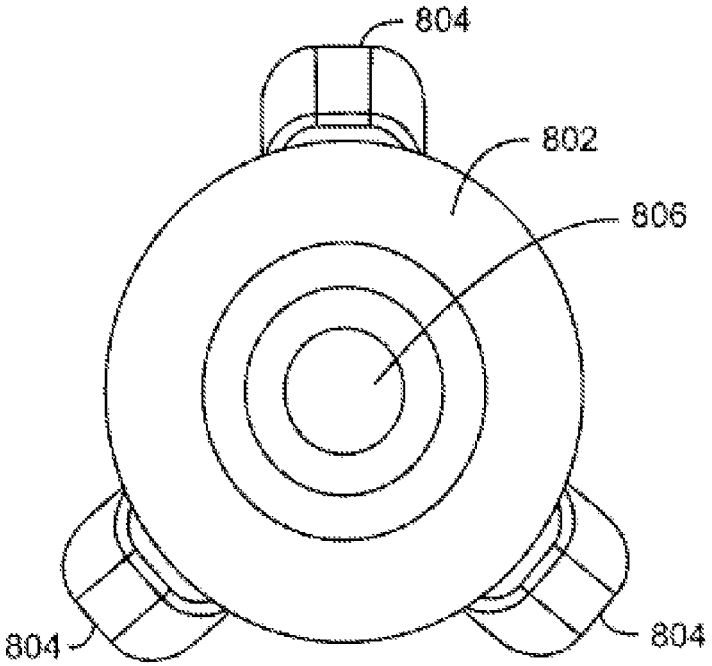
FIGS. 8A and 8B are front views of a three-blade stabilizer with blades extended and retracted, respectively.
Figure 8B:
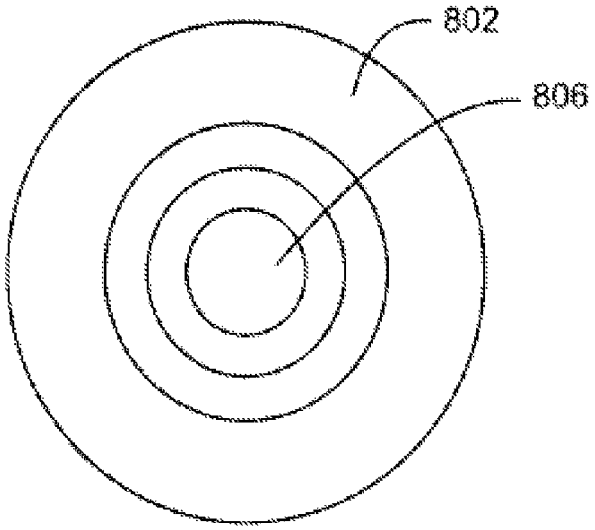

FIGS. 8A and 8B are front views of a three-blade stabilizer with blades extended and retracted. The three-blade stabilizer 800 can have a stabilizer body 802, three one-piece stabilizer blades 804, and a central annulus 806 through which drilling fluid or mud can pass through. During drilling operation in a well, the one-piece stabilizer blades 804 are extended outward to form a larger effective diameter, as shown in FIG. 8A. The larger effective diameter helps keep a drill string stable when drilling. When the drill string is pulled upward and the one-piece stabilizer blades 804 are caught by obstructions in the well, the one-piece stabilizer blades 804 retract inward to reduce the effect diameter so that the stabilizer can bypass the obstruction, as shown in FIG. 8B.

Figure 9A:
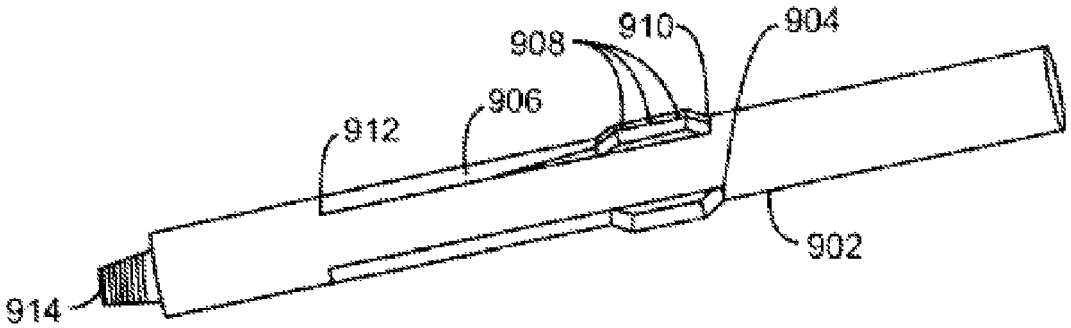
FIGS. 9A and 9B are perspective views of a three-blade two-piece stabilizer with blades extended and retracted, respectively, with FIG. 9C showing an embodiment with a fluid jet nozzle.
Figure 9B:
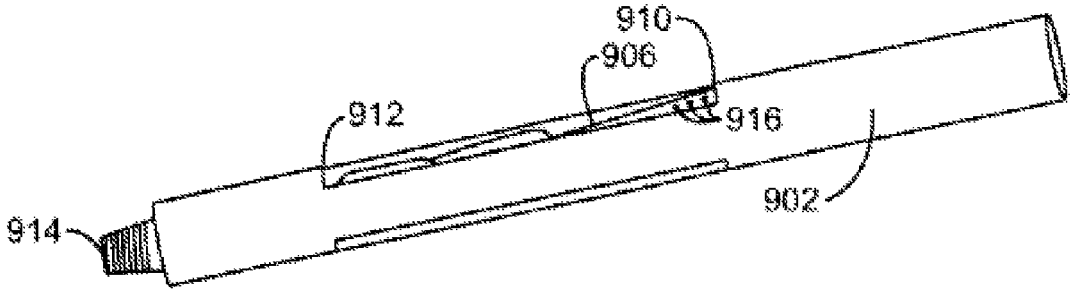

FIGS. 9A and 9B are perspective views of a three-blade two-piece stabilizer with blades extended and retracted. The three-blade two-piece stabilizer 900 can have a stabilizer body 902 with three two-piece stabilizer blades 904, each contained in a stabilizer blade slot 906, which may be angled inward. The two-piece stabilizer blades 904 can be composed of an upper piece and lower piece, and may be held in place by shearable devices 908 such as shear pins or ball detents. The stabilizer blade slots 906 may each contain an upper mechanical stop 910 and a lower mechanical stop 912 that serve to prevent the two-piece stabilizer blades 904 from sliding past a certain point. The three-blade two-piece stabilizer 900 can be inserted into a drill string by a drill string connection 914, which can be a conventional pin or box thread. The drill string connection 914 may point towards the drill bit of the drill string. The novelty of a two-piece stabilizer is that the effective diameter can be reduced incrementally depending on the amount of axial force subjected onto the stabilizer.

Figure 9C:
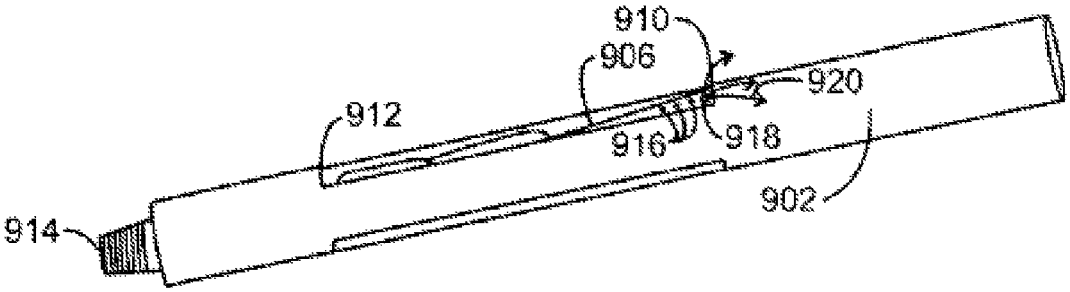

FIG. 9A represents the three-blade two-piece stabilizer 900 during drilling operation in a well, when the two-piece stabilizer blades 904 are extended outward, and held in place by the shearable devices 908 and the upper mechanical stop 910. When the drill string is pulled upwards, one or more of the two-piece stabilizer blades 904 may encounter an obstruction in the well. If a predetermined amount of force is applied onto the two-piece stabilizer blade 904, the shearable devices 908 can release the two-piece stabilizer blade 904, allowing the upper piece to slide down along the lower piece. If a greater amount of force is applied or if the wellbore is more restricted, then both the upper piece and the lower piece can slide down the stabilizer blade slot 906 until reaching the lower mechanical stop 912, revealing shearing holes 916. The shearing holes 916 correspond to where the shearable devices 908 were originally held in place. If the stabilizer blade slot 906 is angled inward, the two-piece stabilizer blade 904 can retract into the three-blade two-piece stabilizer 900 as shown in FIG. 9B. In some embodiments, retracting the two-piece stabilizer blade 904 can expose the fluid jet nozzle 918 (as seen in FIG. 9C), which can release a drilling fluid 920 into the wellbore annulus. If drilling is to be resumed, the drill string may be pushed downward, and the two-piece stabilizer blade 904 can slide back to its original position at the upper mechanical stop 910.

Figure 10A:
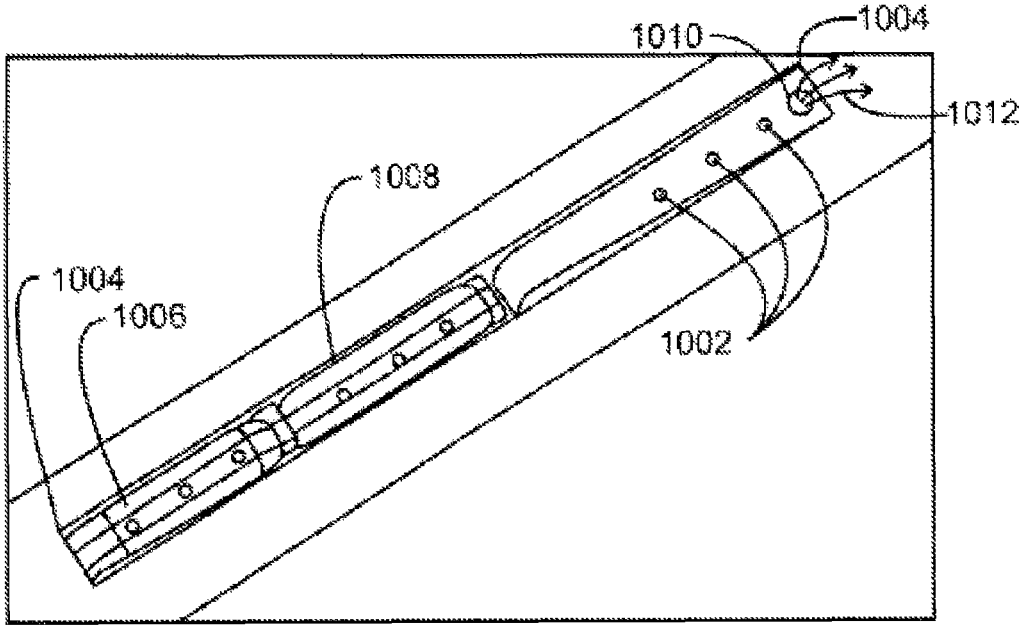
FIGS. 10A and 10B are overhead and front views of a two-piece stabilizer track with blades retracted.
Figure 10B:
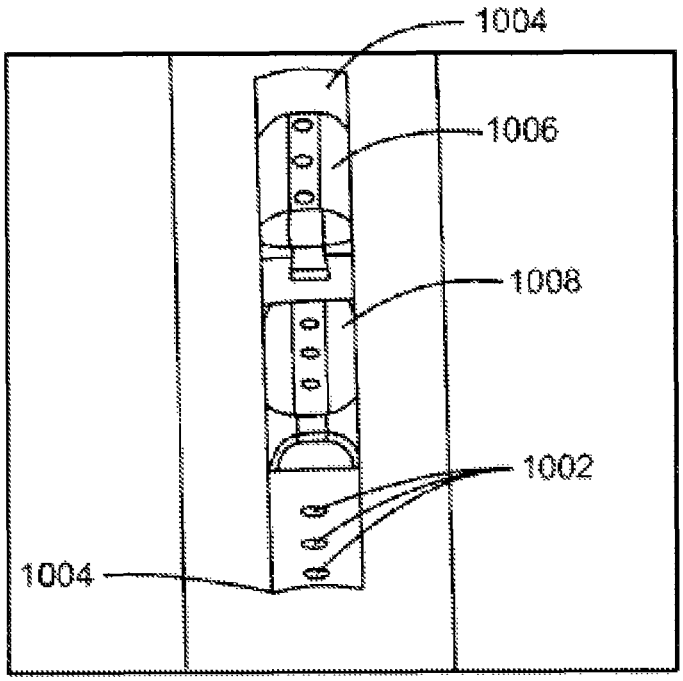

FIGS. 10A and 10B are overhead and front views of a two-piece stabilizer track with blades retracted. The two-piece stabilizer track 1000 can include one or more shearing holes 1002 and a pair of mechanical stops 1004. The shearing holes 1002 are holders for shearable devices (such as pins or detents) that can hold a stabilizer blade in place during drilling operation. If enough force is applied to the stabilizer blade, the shearable devices can release the stabilizer blade, allowing it to slide within the stabilizer track 1000. The mechanical stops 1004 constrain the lateral movement of the stabilizer blade. The two-piece stabilizer track 1000 can be configured such that both an upper piece 1006 and a lower piece 1008 of a two-piece stabilizer can fit separated within the track. The two-piece stabilizer track 1000 can be angled or tapered into the stabilizer body such that when the stabilizer blade slides away from its starting position, the stabilizer blade retracts inward so as to reduce the effective diameter formed. In some embodiments, the two-piece stabilizer track 1000 also contains a hydraulic jet nozzle 1010 that can release a drilling fluid 1012 into the wellbore annulus.

Figure 11A:
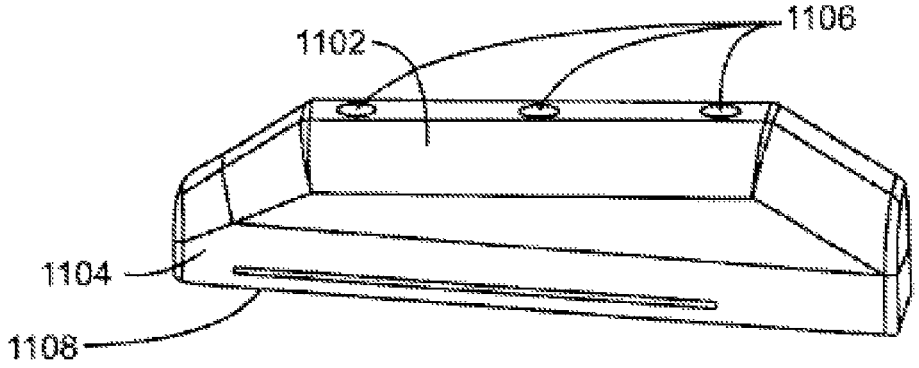
FIGS. 11A and 11B are side and perspective views of a two-piece blade.
Figure 11B:
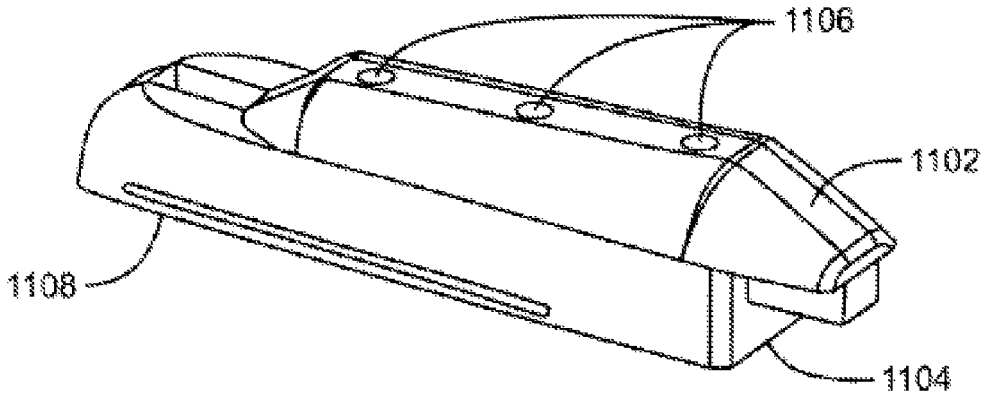

FIGS. 11A and 11B are side and perspective views of a two-piece blade. The two-piece blade 1100 is configured to extend outward from a stabilizer on a drill string so as to increase the stabilizer's effective diameter during drilling operation, as shown in FIG. 11A. The two-piece blade 1100 can include an upper piece 1102 and a lower piece 1104 that are tapered with respect to one another. The upper piece 1102 can be coupled to a track on the lower piece 1104. When the two-piece blade 1100 is subjected to an external force of a predetermined magnitude, the lower piece 1104 can slide axially along the tapered track of the stabilizer body such that the effective diameter of the stabilizer is somewhat reduced. If the stabilizer is subjected to a greater force or if the wellbore is more restricted, the upper piece 1102 can slide along a track on the lower piece 1104 (FIG. 11B), thus reducing the effective diameter even further. The two-piece blade 1100 can contain one or more shearing holes 1106 and one or more retention blades 1108. The shearing holes 1106 are holders for shearable devices (such as pins or detents) that can hold the upper piece 1102 and the lower piece 1104 in place during drilling operation. The retention blade 1108 is a ridge that engages in a blade retention slot on the track on the stabilizer to prevent the two-piece blade 1100 from separating from the stabilizer.

Figure 12A:
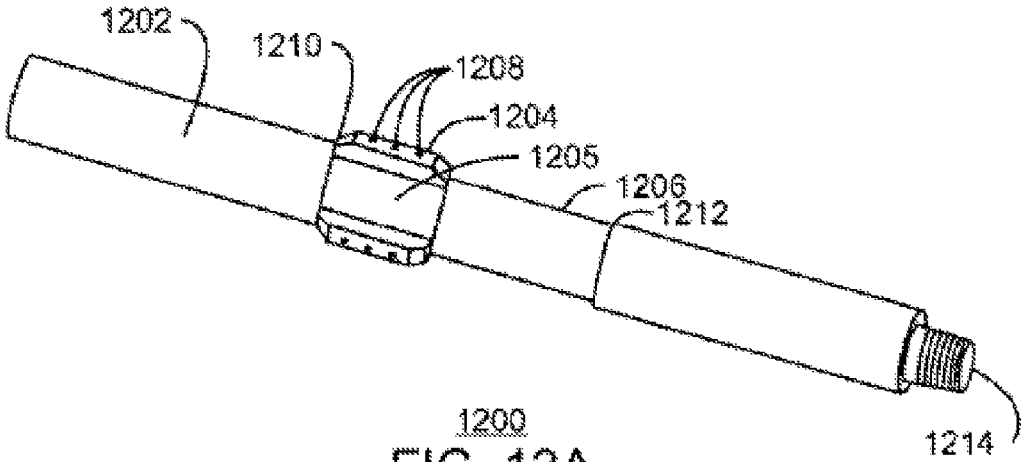
FIGS. 12A and 12B are perspective views of a three-blade sleeve stabilizer with the sleeve in its original and sheared positions, with FIG. 12C showing an embodiment with a fluid jet nozzle.
Figure 12B:
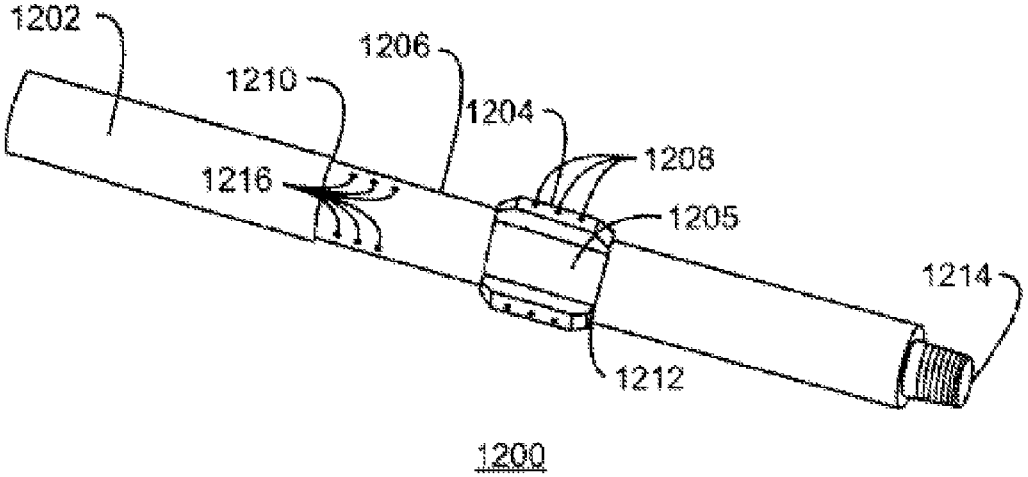

FIGS. 12A and 12B are perspective views of a three-blade sleeve stabilizer with the sleeve in its original and sheared positions. The three-blade sleeve stabilizer 1200 can have a stabilizer body 1202 with stabilizer blades 1204, all of which can be connected to a cylindrical sleeve 1205, which can be operatively coupled to a stabilizer track 1206 on the stabilizer body 1202. The stabilizer blades 1204 on the cylindrical sleeve 1205 may be held in place by shearable devices 1208 such as shear pins or ball detents. The stabilizer track 1206 may contain an upper mechanical stop 1210 and a lower mechanical stop 1212 that serve to prevent the cylindrical sleeve 1205 from sliding past a certain point. The three-blade sleeve stabilizer 1200 can be inserted into a drill string by a drill string connection 1214, which can be a conventional pin or box thread. The drill string connection 1214 may point towards the drill bit of the drill string.

FIG. 12A represents another embodiment of the three-blade sleeve stabilizer 1200 during drilling operation in a well, when the cylindrical sleeve 1205 and the stabilizer blades 1204 are in their original position, and held in place by the shearable devices 1208 and the upper mechanical stop 1210. This embodiment does not employ tapered surfaces as described previously so the effective diameter of the stabilizer does not change. When the drill string is pulled upwards, one or more of the stabilizer blades 1204 may encounter an obstruction in the well.

If enough force is applied onto the stabilizer blade 1204, the shearable devices 1208 can release cylindrical sleeve 1205, allowing it to slide down the stabilizer track 1206 until reaching the lower mechanical stop 1212, revealing shearing holes 1216, as shown in FIG. 12B. This allows a jarring or hammering action to occur which may dislodge the obstruction. In many embodiments the stabilizer blade 1204 is a one-piece element, but in other embodiments the stabilizer sleeve 1205 may encompass more than one stabilizer blade 1204. The shearable devices 308 may include shear pins that break when a force exceeds a set point. The force required to release the stabilizer sleeve 1205 can fall in a range from the minimum force required to break the shear pins on a single stabilizer blade 1204, for example, as discussed with respect to FIG. 3, to the total force required to break the shear pins of all of the stabilizer blades 1204 coupled to the stabilizer sleeve 1205. For example, if three shear pins are used per blade for a three blade sleeve, each shear pin can be set to break at about 10,000 lbs (about 4500 kg), for a total force of about 90,000 lbs (about 41000 kg). The force required to release the stabilizer sleeve 1205 may fall between 10,000 lbs (about 4500 kg) and 30,000 lbs (about 1400 kg). The shearable devices 308 are not limited to shear pins, but can also include detents that lock the stabilizer blades 304 into place until the forces described are reached.

Figure 12C:
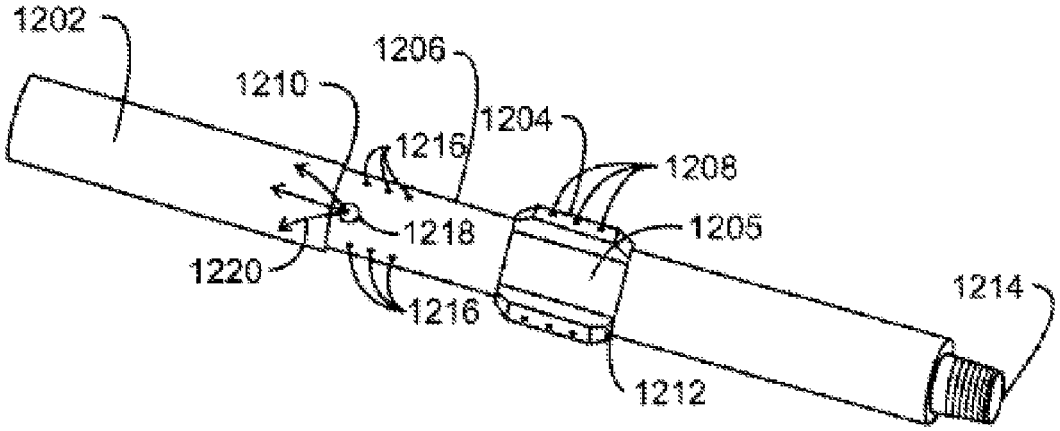

The shearing holes 1216 correspond to where the shearable devices 1208 were originally held in place. In some embodiments, retracting the cylindrical sleeve 1205 can expose the fluid jet nozzle 1218 (as seen in FIG. 12C), which can release a drilling fluid 1220 into the wellbore annulus.

Figure 14A:
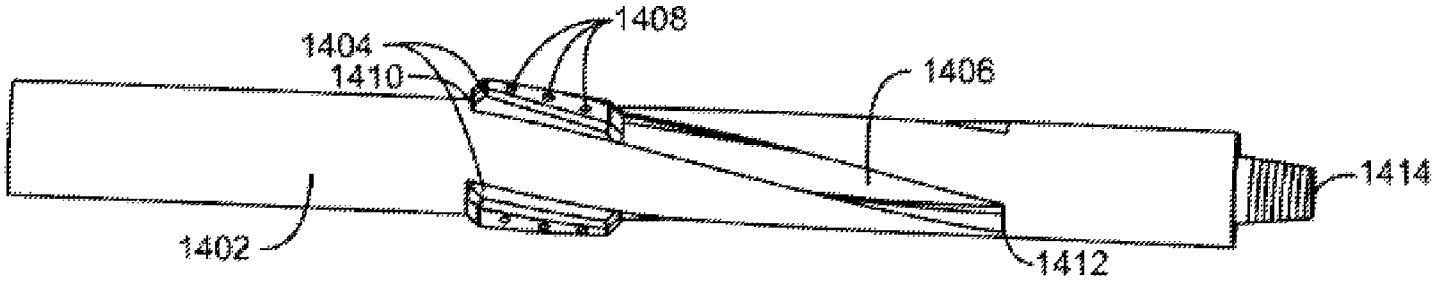
FIGS. 14A and 14B are side views of a three-blade spiral stabilizer with blades extended and retracted, with FIG. 14C showing an embodiment with a fluid jet nozzle.
Figure 14B:
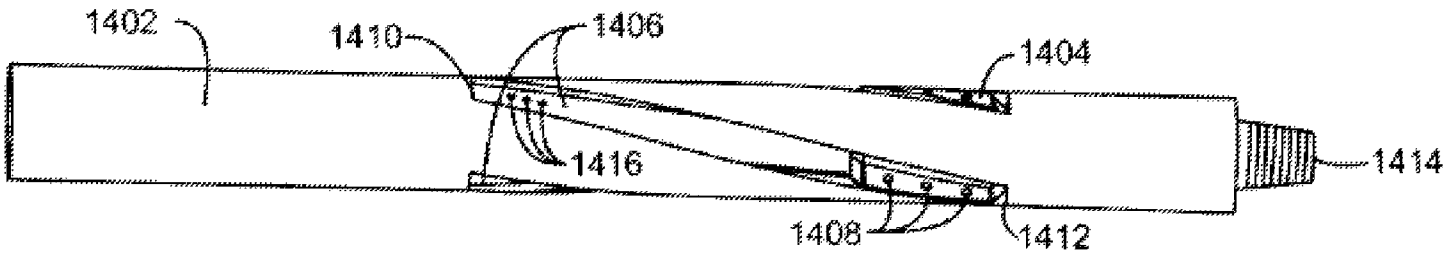

In some embodiments, a hydraulic jet nozzle is included on the stabilizer track 1206 to release a drilling fluid into the wellbore annulus as the cylindrical sleeve 1205 slides or when the stabilizer blades are shifted downwards FIG. 14B. The released drilling fluid can act as a lubricant or help displace some of the obstructive debris. If drilling is to be resumed, the drill string may be pushed downward, and the cylindrical sleeve 1205 can slide back to its original position at the upper mechanical stop 1210.

Figure 13:
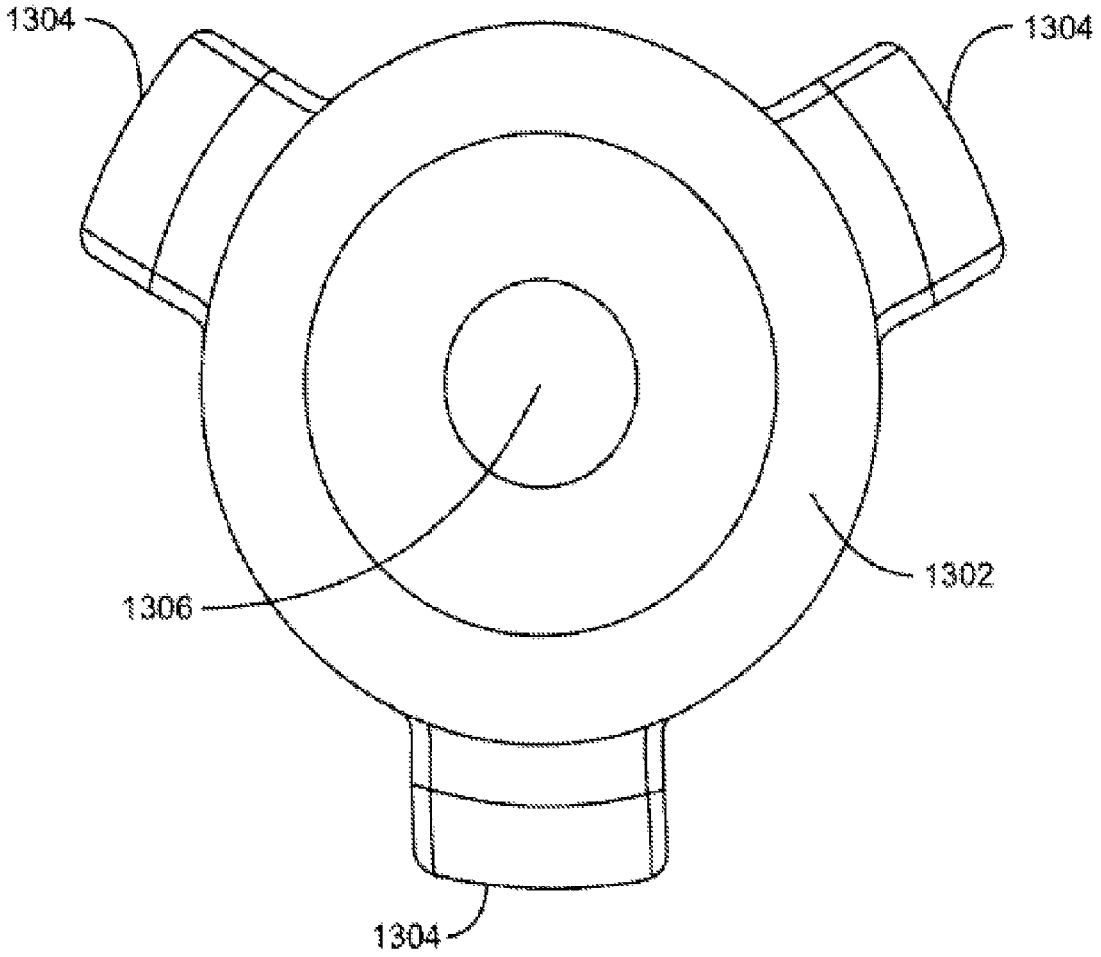
FIG. 13 is a front view of a three-blade sleeve stabilizer.

FIG. 13 is a front view of a three-blade sleeve stabilizer. The three-blade sleeve stabilizer 1300 can have a stabilizer body 1302, three stabilizer blades 1304 connected to a cylindrical sleeve 1305, and a central annulus 1306 through which drilling fluid or mud can pass through. The stabilizer blades 1304 are extended outward to form a larger effective diameter, as shown in FIG. 13. The larger effective diameter helps keep a drill string stable when drilling. When the drill string is pulled upward and the stabilizer blades 1304 are caught by obstructions in the well, the stabilizer blades 1304 retain the effective diameter. The drill string can be pushed and pulled repeatedly in order to use the stabilizer blades 1304 as a hammer to dislodge the obstructions.

FIGS. 14A and 14B are side views of a three-blade spiral stabilizer with blades extended and retracted. The three-blade spiral stabilizer 1400 can have a stabilizer body 1402 with three one-piece stabilizer blades 1404, each contained in a stabilizer blade slot 1406, which may be angled inward. Each stabilizer blade slot 1406 is aligned at an angle to the axis of the drill string. The one-piece stabilizer blades 1404 may be held in place by shearable devices 1408 such as shear pins or ball detents. The stabilizer blade slots 1406 may each contain an upper mechanical stop 1410 and a lower mechanical stop 1412 that serve to prevent the one-piece stabilizer blades 1404 from sliding past a certain point. The three-blade stabilizer 1400 can be inserted into a drill string by a drill string connection 1414, which can be a conventional pin or box thread. The drill string connection 1414 may point towards the drill bit of the drill string.

Figure 14C:
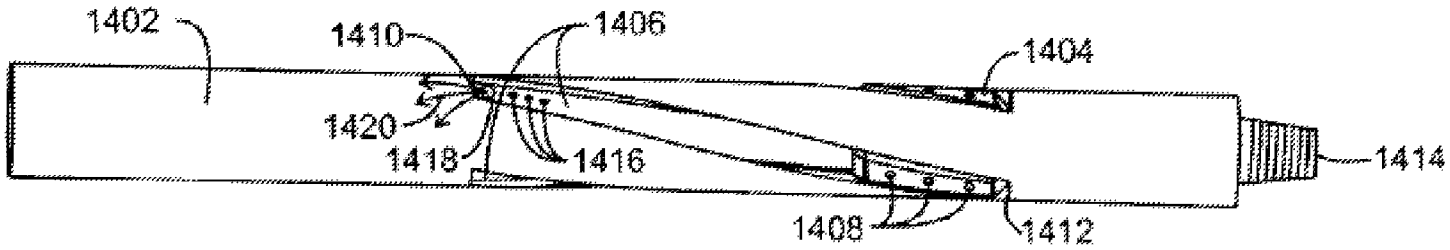

FIG. 14A represents the three-blade stabilizer 1400 during drilling operation in a well, when the one-piece stabilizer blades 1404 are extended outward, and held in place by the shearable devices 1408 and the upper mechanical stop 1410. When the drill string is pulled upwards, one or more of the one-piece stabilizer blades 1404 may encounter an obstruction in the well. If enough force is applied onto the one-piece stabilizer blade 1404, the shearable devices 1408 can release the one-piece stabilizer blade 1404, allowing it to slide down the stabilizer blade slot 1406 until reaching the lower mechanical stop 1412. The amount of force required for the shearable devices 1408 to release the one-piece stabilizer blade 1404 of a spiral stabilizer may be similar to the force required to release a stabilizer blade of a straight stabilizer. If the stabilizer blade slot 1406 is angled inward, the one-piece stabilizer blade 1404 can retract into the three-blade stabilizer 1400 as shown in FIG. 14B. Because the stabilizer blade slot 1406 is at an angle to the axis of the drill string, the one-piece stabilizer blade 1404 moves around the stabilizer body 1402 in a spiral-like path, revealing shearing holes 1416. The shearing holes 1416 correspond to where the shearable devices 1408 were originally held in place. If the stabilizer blade slot 1406 is angled into the drill pipe, the one-piece stabilizer blade 1404 can retract into the three-blade stabilizer as shown in FIG. 14B. In some embodiments, retracting the one-piece stabilizer blade 1404 can expose the fluid jet nozzle 1418 (as seen in FIG. 14C), which can release a drilling fluid 1420 into the wellbore annulus. If drilling is to be resumed, the drill string may be pushed downward, and the one-piece stabilizer blade 1404 can slide back to its original position at the upper mechanical stop 1410.

Figure 15:
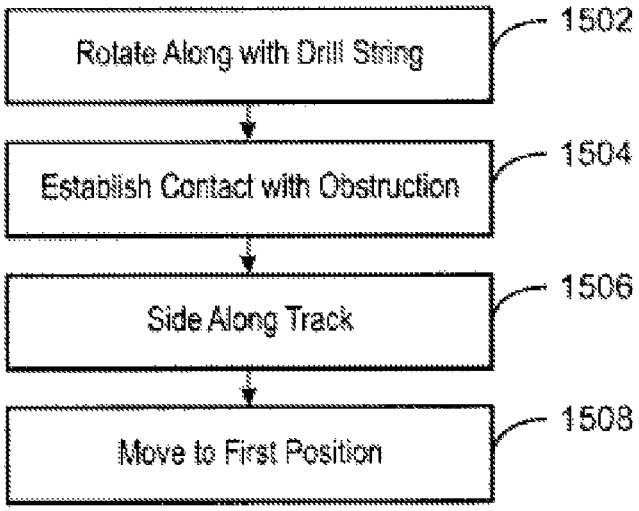
FIG. 15 is a process flow chart of a method of minimizing drill string sticking between a stabilizer and an obstruction in a well.

FIG. 15 is a process flow chart of a method of minimizing drill string sticking between a stabilizer and an obstruction in a well. The method 1500 can be performed by the embodiments discussed above, or any stabilizer that includes a stabilizer blade operatively coupled to a track.

At block 1502, the stabilizer blade rotates along with a drill string during drilling operation. At this stage, the stabilizer blade remains static at a first position along the axis of the drill string. In some embodiments, the stabilizer blade can be held in place by an upper mechanical stop to prevent it from sliding up the drill string's axis, or by one or more shearable devices such as shear pins or detents.

At block 1504, the stabilizer blade can establish contact with an obstruction in the wellbore due to the larger effective diameter formed by the stabilizer blade. This event can occur after drilling operation has been completed, as the drill string is pulled upward towards the surface.

At block 1506, the stabilizer blade slides downward along the track due to the force imposed by the obstruction. A lower mechanical stop may be included on the stabilizer to prevent the stabilizer blade from sliding past a certain point. In some embodiments, the stabilizer blade retracts into a tapered slot in the stabilizer, reducing the effective diameter and allowing the stabilizer to bypass the obstruction. In other embodiments, the stabilizer blade is coupled to a cylindrical sleeve, which retains its effective diameter. The sleeve can be used as a hammer to dislodge the obstruction as the drill string is pushed and pulled repeatedly. In some embodiments, the act of sliding the stabilizer blade also reveals (or unseals) a hydraulic jet nozzle configured to release a drilling fluid into the wellbore annulus to assist in bypassing or dislodging the obstruction.

At block 1508, the stabilizer blade can slide into the first position if the drill string is lowered. This stage can occur if drilling operation is to resume once more.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the appended claims.

What is claimed is:

1. A stabilizer for use with a rotatable drill string, the stabilizer comprising:

a track disposed along a tubular body; and a stabilizer blade operatively coupled to the track, wherein the stabilizer blade is releasably secured at a first position along the track with respect to axial movement of the tubular body in either direction by a first position retention mechanism providing a first threshold force, the stabilizer blade comprising a first blade piece releasably engaged with a second blade piece by a two-piece engagement mechanism forming the stabilizer blade, the track allowing the stabilizer blade to slide from the first position to a second position along the track solely in response to a first particular force acting on the stabilizer blade external to the tubular body, the first particular force being in excess of the first threshold force causing the stabilizer blade to disengage from the first position retention mechanism and slide from the first position to the second position wherein the first piece and the second piece are retained at the second position by a second position retention mechanism and in the second position the second piece is at least partially retracted into the tubular body; and wherein the first piece of the stabilizer blade is released from engagement with the second piece at the second position when the first piece is subjected to a disengaging particular force at the second position acting on the first piece external to the tubular body, the disengaging particular force being in excess of a second threshold force that defeats the two-piece engagement mechanism to enable the first piece to releasably disengage from the second piece whereby the first piece moves along at least one of the second piece and the track to at least partially retract into the tubular body.

2. The stabilizer of claim 1, wherein the first position retention mechanism comprises a shearable device configured to hold the stabilizer blade in the first position along the track when external force acting on the stabilizer blade is below the first particular force.

3. The stabilizer of claim 2, wherein the shearable device is configured to allow the stabilizer blade to move from the first position in response to the first particular force when the first particular force is an axial force differential between the stabilizer blade and the tubular body.

4. The stabilizer of claim 3, wherein the force differential between the first particular force and the first threshold force is at least 10,000 kg.

5. The stabilizer of claim 3, further comprising a plurality of stabilizer blades, wherein each stabilizer blade of the plurality of stabilizer blades is configured to move independently of other of the plurality of stabilizer blades.

6. The stabilizer of claim 3, wherein the first position retention mechanism comprises a detent mechanism configured to hold the stabilizer blade in the first position along the track.

7. The stabilizer of claim 6, wherein the detent mechanism is configured to reengage the stabilizer blade upon the return of the stabilizer blade to the first position.

8. The stabilizer of claim 1, wherein the second position retention mechanism comprises a mechanical stop configured to prevent the second piece of the stabilizer blade from sliding past the second position on the track.

9. The stabilizer of claim 1, wherein the track comprises an angled track configured to move the stabilizer blade into a recessed position along the tubular body.

10. The stabilizer of claim 1, wherein the track is aligned along with the axis of the tubular body.

11. The stabilizer of claim 1, wherein the track is aligned at an angle to the axis of the tubular body.

12. The stabilizer of claim 1, wherein the first piece configured to slide along a slot on the second piece.

13. The stabilizer of claim 1, wherein the stabilizer blade is mounted on a stabilizer sleeve and the stabilizer sleeve is provided on the tubular body.

14. The stabilizer of claim 1, comprising a hydraulic jet nozzle on the track, wherein the hydraulic jet nozzle is configured to release fluid into a wellbore annulus external to the tubular body.

15. The stabilizer of claim 14, wherein the hydraulic jet nozzle is blocked when the stabilizer blade is in the first position.

16. The stabilizer of claim 14, wherein the hydraulic jet nozzle is exposed when the stabilizer blade is in the second position.

17. A method for stabilizing a rotatable drill string in a wellbore, comprising:

providing a stabilizer according to claim 1 within the drill string;

advancing the drill string into the wellbore;

centering the drill string including a plurality of stabilizer blades disposed along the drill string, wherein each of the plurality of stabilizer blades remains at a first extended position on a track as the drill string is advanced into the wellbore; and retracting the drill string in the wellbore, wherein at least one of the plurality of stabilizer blades slides to the second position along the track solely in response to being caught on an obstruction in the wellbore, wherein the obstruction exerts the first particular force axially upon the stabilizer blade in excess of the first threshold force, the first particular force causing the at least one stabilizer blade to disengage from the first position retention mechanism and slide into the second position, and at least partially retract the second piece into the tubular body.

18. The method of claim 17, comprising releasing a fluid from a hydraulic jet nozzle, the released fluid being released into the track and then into an annulus of the wellbore.

19. The method of claim 17, comprising retracting the stabilizer blade to a smaller effective diameter when the stabilizer blade slides to the second position.

20. The method of claim 17, comprising moving the drill string axially to dislodge the obstruction.

21. The method of claim 17, further comprising:

retracting the drill string in the wellbore when the stabilizer blade is positioned at the second position, wherein subsequent to engagement with the obstruction the retracting of the drill string at the second position subjects the first piece of the stabilizer blade to the disengaging particular force acting axially upon the first piece of the stabilizer blade external to the tubular body, the disengaging particular force being in excess of the second threshold force that defeats the two-piece engagement mechanism to enable the first piece to releasably disengage from the second piece whereby the first piece moves along at least one of the second piece and the track to at least partially retract the first piece into the tubular body.

* * * * *